US005240410A

United States Patent [19]

Yang et al.

[11] Patent Number: 5,240,410

[45] Date of Patent: Aug. 31, 1993

[54] DUAL FUEL LOW NOX BURNER

[75] Inventors: Shyh-Ching Yang, Taipei, Taiwan; Steven J. Bortz, Irvine, Calif.

[73] Assignee: Industrial Technology Research Institute, Hsinchu, Taiwan

[21] Appl. No.: 817,568

[22] Filed: Jan. 7, 1992

[51] Int. Cl.[5] ..... F23Q 9/00

[52] U.S. Cl. ..... 431/284; 431/183; 431/187; 431/285; 239/400; 239/405

[58] Field of Search ..... 431/278, 285, 284, 182, 431/181, 183, 184, 187, 350, 10; 239/400, 405, 406

[56] References Cited

U.S. PATENT DOCUMENTS

| | | | |
|---|---|---|---|
| 2,793,686 | 5/1957 | Phillips | 431/183 |
| 4,098,255 | 7/1978 | Nowak et al. | 431/284 |
| 4,351,632 | 9/1982 | Nagai | 431/183 |
| 4,379,689 | 4/1983 | Morck, Jr. | 431/284 |
| 4,412,808 | 11/1983 | Sheppard et al. | 431/284 |
| 4,451,230 | 5/1984 | Bocci et al. | 431/183 |
| 4,629,413 | 12/1986 | Michelson et al. | 431/188 |
| 5,129,818 | 7/1992 | Balsiger | 431/187 |

FOREIGN PATENT DOCUMENTS

| | | |
|---|---|---|
| 3048201A1 | 7/1982 | Fed. Rep. of Germany . |
| 3600665C1 | 7/1987 | Fed. Rep. of Germany . |

*Primary Examiner*—James C. Yeung

*Attorney, Agent, or Firm*—Townsend and Townsend Khourie and Crew

[57] ABSTRACT

Disclosed is a structure of a burner which can be fueled with gas fuel or oil fuel. The main features includes: a specially designed swirl generator; an annular hollow gas gun; an oil gun received in the gas gun where the gas jets of the gas gun and the oil jets of the oil gun have an predetermined angle with respect to the centerline. Under designed operating conditions, a swirling air flow can be generated with a low pressure drop and low turbulences, which is beneficial to flame stability, reducing flame temperature, and delaying the mixing of air and fuel, thus inhibiting the formation of $NO_x$. Staging air and flue gas recirculation are available for further reduction of nitrogen oxides.

18 Claims, 8 Drawing Sheets

DUAL FUEL LOW NOX BURNER

FIELD OF THE INVENTION

The present invention relates to a burner, especially to a dual fuel burner having low $NO_x$ emissions.

BACKGROUND OF THE INVENTION

Environment preservation has become more and more important through the entire world. As been discovered, $NO_x$ is the major cause of acid rain. In fact, almost all $NO_x$ comes from burning fossil fuels. As a result, stringent regulations to reduce the allowable emissions of nitrogen oxides are being promulgated in many industrial areas of the world. Examples are listed in table I.

TABLE I effective as from 1993
$NO_x$ emissions standards for different kind of fuels in several countries (unit: ppm)

| | coal | oil | gas | dry, $O_2$ % |
|---|---|---|---|---|
| R.O.C. | 500 | 400 | 300 | 6 |
| | *(350) | *(250) | *(150) | |
| Japan | 250 | 150 | 100 | 6 |
| U.S.A. | 382 | 236 | 78 | 3 |
| Germany | 213 | 106 | 106 | 3 |

The combustion industry is faced with the necessity of having to reduce nitrogen oxides from its existing units. Under such stringent regulations, conventional combustion technologies are not capable of meeting standards for low $NO_x$ emissions. For this reason, methods for reducing nitrogen oxides in furnaces have been developed. These methods can be divided into two groups: combustion modification and post-treatment. Combustion modification means reducing the $NO_x$ contained in flue gas by way of low $NO_x$ combustion technologies, for instance, the present invention. On the other hand, post-treatment methods treat the flue gas by adding reducing agents, like ammonia or urea, for reducing the nitrogen oxides to nitrogen. Examples include processes of selective catalyst reduction and selective non-catalyst reduction.

The formation of $NO_x$ in the combustion process consists of thermo-$NO_x$ and fuel-$NO_x$. Thermo-$NO_x$ mostly depends on the peak temperature of the flame. Fuel-$NO_x$ is decided by the nitrogen content of the fuel and the mechanism of the combustion reaction. Nowadays, methods for reducing $NO_x$ emissions by the combustion modification include:

1. changing the operating conditions of the combustion system by:

(a) decreasing the amount of excess air. More excess air means higher oxygen density during combustion, which is beneficial to the formation of $NO_x$. Therefore, by decreasing the amount of excess air to operate the combustion system nearly under the condition of complete combustion is helpful to reduce the $NO_x$ emissions. In addition, due to the reduction of the amount of air, less heat is taken away by the flue gas, resulting in an increased combustion efficiency.

(b) lowering the heat load or increasing the space for combustion. This leads to an increased heat transfer rate and a lower combustion temperature, so as to reduce the formation of thermo-$NO_x$. The shortcomings are the diminished capacity of the furnace and poorer economic efficiency.

(c) lowering the pre-heat temperature of the air. This effectively lowers the flame temperature and thus reduces the thermo-$NO_x$. From the point of view of energy saving, this will cause the loss of useful energy.

2. modifications to the burner or the combustion system, comprising:

(a) staging air combustion. Air is injected into the combustion system at different positions. The central region of the flame forms a fuel-rich reduction area, which inhibits the formation of $NO_x$. This can slow down the mixing rate of the air and the fuel, which lowers the peak temperature of flame, and then reduces the $NO_x$.

(b) swirl combustion. Air is guided into the furnace by a swirler. The swirling air flow delays the mixing of the air and the fuel, and forms a recirculation area at the central region, thus lowering the peak temperature of the flame, and reducing the $NO_x$.

(c) reburning. The combustion process is divided into a main combustion area, a reburning area, and a burnout area. The main combustion area is supplied with 80% of the fuel and kept under a fuel-lean condition. In the reburning area, 10% to 20% of the fuel is injected downstream from the main combustion area, to create a fuel-rich reduction area. After that, in the burnout area, 0 to 10% of the fuel and abundant air are supplied to burn out all fuel particles that have not burned in the previous areas.

(d) flue gas recirculation. A part of the exhaust gas is cooled and guided back to mix with fresh air and then sent into the burner. The flame temperature can be lowered, the oxygen is diluted, and the $NO_x$ is reduced.

Generally speaking, the design principle of a low $NO_x$ burner can be one or a combination of the methods and techniques mentioned above. Such a burner should be operated under a low excess air condition. Regarding the gas-fueled burner, the major source of $NO_x$ is the thermal-$NO_x$, therefore the reduction of thermal-$NO_x$ is to be taken as the first goal. For the oil-fueled burner, due to the nitrogen contained in the fuel, the reduction of fuel-$NO_x$ should be considered simultaneously. Nevertheless, the mechanism of formation of fuel-$NO_x$ is more complex than that of thermal-$NO_x$. There are no well developed technologies capable of eliminating fuel-$NO_x$ completely, so the $NO_x$ emissions of the oil-fueled burner are still higher than those of the gas-fueled burner.

SUMMARY OF THE INVENTION

As stringent regulations to reduce the allowable emissions of nitrogen oxides are being promulgated in many industrial areas of the world, and conventional burners are not capable of conforming such regulations, the development of low $NO_x$ burners has become more significant nowadays.

The present invention discloses a dual fuel low $NO_x$ burner utilizing swirling burning, staging combustion and flue gas recirculation for reducing nitrogen oxides. With 3% excess oxygen, the best result is 8 ppm $NO_x$ by burning natural gas, 59 ppm $NO_x$ by burning No. 2 oil, or 103 ppm by burning No. 6 oil. These results means the present invention conforms to the strict regulations in the U.S.A., Europe, Japan, or Taiwan.

The burner according to the present invention is featured in: a specially designed swirl generator, an annular hollow gas gun, and an oil gun received in the gas gun, where the gas jets of the gas gun and the oil jets of the oil gun have an predetermined angle with the centerline. Under designed operating conditions, a swirling air flow can be generated with a low pressure drop and low turbulences, which is beneficial to flame stability, reducing flame temperature, and delaying the mixing of air and fuel, thus inhibiting the formation of $NO_x$. Staging air and flue gas recirculation are available for further reduction of nitrogen oxides.

The present invention comprises a refractory divergent quarl, having an entrance and an exit and a plurality of axially extending staging air inlets equally spaced around said exit; a wind pipe coaxially connected to said entrance of said divergent quarl, having a primary combustion air inlet; a swirl generator coaxially received in said wind pipe, having a plurality of vanes of a predetermined curvature, and a center hole; a gas gun, comprising a hollow annular tube coaxially received in said center hole of said swirl generator, a gas nozzle mounted on one end of said annular tube near said entrance of said divergent quarl, and a gas inlet, said gas nozzle having a plurality of through holes; an oil gun, comprising a hollow oil tube coaxially received in said annular tube of said gas gun, an oil nozzle mounted on one end of said oil tube near said entrance of said divergent quarl, an oil inlet on said oil tube, a high pressure air tube received in said oil tube, and a high pressure air inlet on said high pressure air tube, said oil nozzle having a plurality of through holes.

The further scope of applicability of the present invention will become apparent from the detailed description given hereinafter. However, it should be understood that the detailed description and specific examples described herein, while indicating preferred embodiments of the invention, are given by way of illustration only, since various changes and modifications within the spirit and scope of the invention will become apparent to those skilled in the art from this detailed description.

BRIEF DESCRIPTION OF THE FIGURES

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENT

Figure 1:
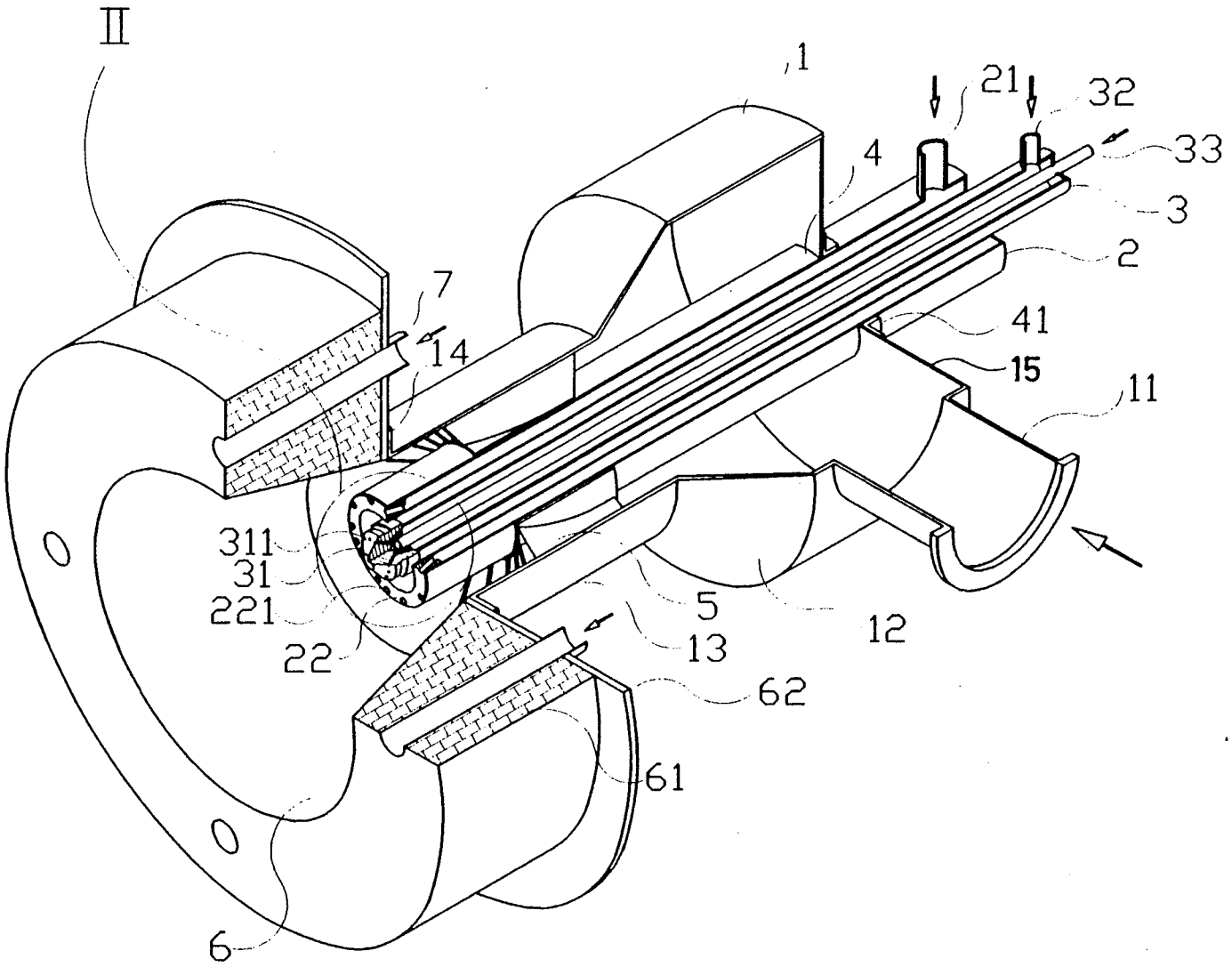
FIG. 1 is a partly cross-sectional perspective view showing the structure of a duel fuel low $NO_x$ burner according to the present invention.
Figure 3:
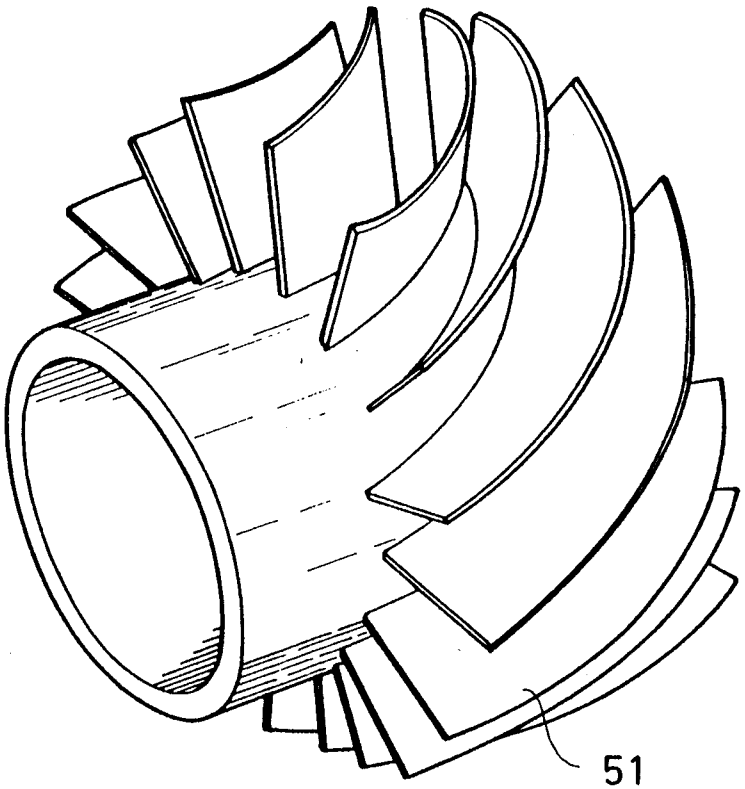
FIG. 3 a perspective view showing a swirl generator of the burner according to the present invention.

Please refer to FIG. 1. The burner assembly according to the present invention consists essentially of a windbox 1, a gas gun 2, an oil gun 3, a supporting barrel 4, a swirl generator 5, a divergent quarl 6 and a staging air inlet 7. The burner assembly is adapted to accommodate to a furnace. The primary combustion air enters the windbox 1 from a primary air intake 11, and then flows through a convergent pipe 12, into a neck pipe 13. The neck pipe 13 accommodates the swirl generator 5, which is disclosed in the patent of the Republic of China, Pat. No. 61534. The perspective view of the swirl generator 5 is shown in FIG. 3. The vanes 51 of the swirl generator 5 have a predetermined curvature to change the direction of air flow and to create a swirling flow in the quarl 6. In addition, the curvature of the vanes results in a low pressure drop and low turbulences. Downstream the swirl generator 5 is the quarl 6. When the combustion air passes the swirl generator 5, it establishes a high velocity swirling air flow expanding from the quarl 6 to the furnace (not shown), creating strong recirculation back to the flame root. The strong internal recirculation gives enhanced flame stability and reduced flame temperatures which, in turn, reduce $NO_x$ emissions.

Quarl 6 is made by refractory material 61 and forms a divergent nozzle. The refractory material 61 is fixed on a back plate 62 with four staging air inlets 7. A windbox flange 14 of the windbox 1 is mounted on the back plate 62 and therefore the windbox 1 is fixed. Staging air is injected into the furnace by way of the staging air inlets 7. As mentioned above, by staging air combustion, the injected fuel and the primary combustion air form a fuel-rich reduction area at the central region of the flame, which inhibits the formation of $NO_x$. The residual fuel particles will be completely burned by supplying staging air.

Figure 2:
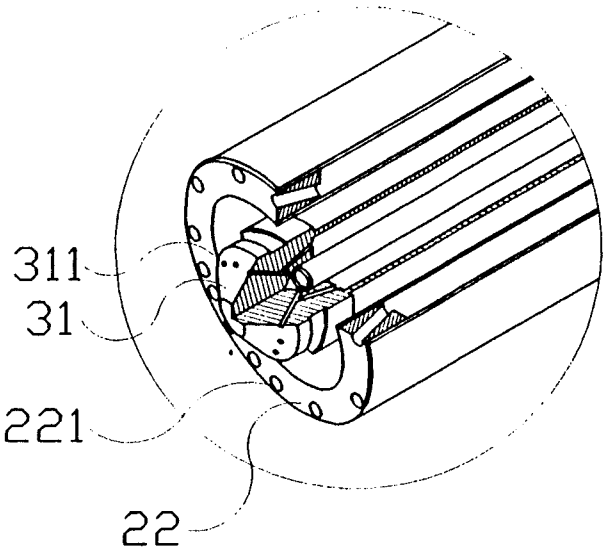
FIG. 2 is an enlarged perspective view showing the structure of the gas gun and the oil gun of the burner according to the present invention.
Figure 4:
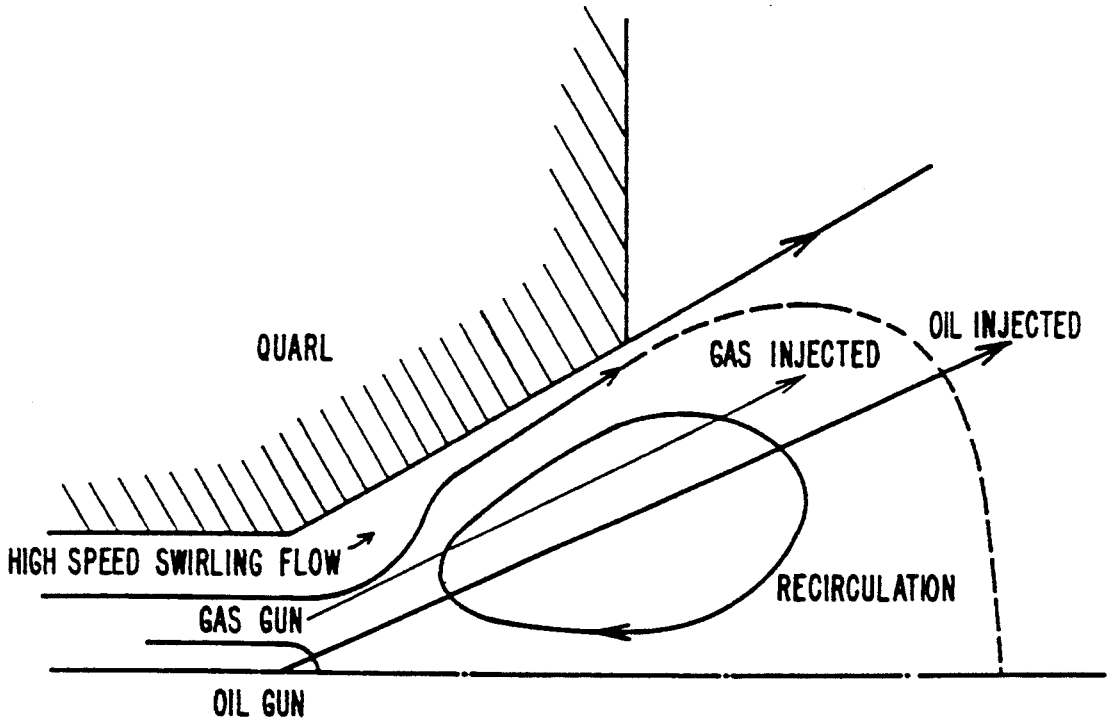
FIG. 4 is a schematic diagram showing the flow field of the flame at the quarl.

The gas gun 2 is an annular hollow cylinder, provided with a gas fuel inlet 21 at its one end. Another end has a gas nozzle 22. As shown in FIG. 2, several gas jets 221 are equally spaced on the periphery of the gas nozzle 22. The gas jets 221 are angled with the centerline of the burner in a predetermined angle. Gas fuel after being injected passes through the recirculation area, then mixes with the combustion air, as shown in FIG. 4. Consequently, a delay in the fuel and air mixing can be achieved, and the fuel-rich combustion is strengthened, which further lower $NO_x$ emissions. The gas gun 2 is received in the supporting barrel 4. One end of the supporting barrel 4 is provided with a barrel flange 41 for fixing thereon a side plate 15 of the windbox 1. The swirl generator 5 is mounted on the other end of the supporting barrel 4.

The oil gun 3 is inserted in the gas gun 2, with an oil nozzle 31 provided at its one end. A tube is inserted in the oil gun 3, which forms a high pressure air inlet 33. Compressed air is guided into the high pressure air inlet 33. The interior of the oil gun 3 forms a hollow tubular passage. The oil nozzle 31 has a plurality of "Y" shaped oil jets 311. Liquid fuel enters the oil gun 3 from the oil inlet 32, and flows to the oil nozzle 31 through the hollow tubular passage. After being mixed with and atomized by the compressed air, fuel is squirted from the oil jets 311 at a high velocity and at a predetermined angle with respect to the centerline of the burner. The gas gun and the oil gun of the present invention are detachable and their positions are adjustable, whereby an operating person can easily adjust the fuel supply to achieve an efficient operating condition, or repair the system.

Flue gas recirculation can be also utilized in the present invention. Flue gas may be guided to mix with the primary combustion air and then enter the windbox 1 to form the primary air intake 11. Otherwise, flue gas may be guided into the combustion system from the staging air inlet 7. By another way, a flue gas entrance may be provided on the convergent pipe 12 and the flue gas can be guided into the windbox 1 from the entrance and mixed with the primary combustion air. The purpose of the flue gas recirculation is to lower the peak temperature of the flame and to dilute the oxygen in the combustion air, consequently lowering thermal $NO_x$ emissions.

What is disclosed above is the structure and function of the present invention. The features of the present invention are further described as follows:

1. Staging air can be applied together with flue gas recirculation.
2. An annular gas gun is a hollow tubular gas gun for gas fuel.
3. Gas fuel is injected at an angle of 15 to 40 degrees with respect to the centerline.
4. Gas fuel is injected into the quarl at a speed of 20 to 150 m/sec.
5. Primary combustion air enters the quarl and encircles the gas gun.
6. Primary combustion air enters at a speed of 7 to 70 m/sec.
7. The primary combustion air is of 60–90% of the total amount of air supplied.
8. Swirl number of the primary combustion air, i.e. the tangential momentum over the axial momentum and the radius, is 0.5 to 1.5.
9. The outer diameter of the gas gun over the inner diameter of the neck pipe 13 is 0.45 to 0.75.
10. The primary combustion air passes through swirl generator (which is a patent of the Republic of China, Pat. No. 61534) and forms a low turbulence swirling flow for controlling the mixing of air and fuel.
11. Fuel and primary air are mixed in a special designed quarl wherein the diameter of the exit is 2 to 3 times the diameter of the entrance, and the inner periphery has an angle of 18 to 37 degrees with respect to the centerline.
12. Total combustion air supplied is 1.05 to 1.3 times the minimum amount of air necessary for complete combustion.
13. 3 to 8 staging air inlets, equally spaced, disposed at the circumference of the quarl.
14. Staging air enters the combustion chamber at a speed of 14 to 80 m/sec.
15. No. 2 or No. 6 heavy oil is injected from "Y" shaped oil jets of the oil gun 3.
16. Oil particles are injected at a speed of 80 to 400 m/sec.
17. Oil particles are injected at an angle of 15 to 40 degrees with respect to the centerline.
18. The average diameter of the oil particles is 20 to 40 microns.
19. The gas gun and oil gun are adjustable.

An experiment is made to examine the $NO_x$ emissions of the present invention. Therefore, a dual fuel low $NO_x$ emissions burner is designed and made to operate in a range of 2 to $10\times10^6$ Btu/hr. The gas nozzle of the burner has 20 gas jets 221 at an angle of 25 degrees with respect to the centerline. The oil nozzle has 6 oil jets 311 at an angle of 22 degrees with respect to the centerline. The diameter of the exit of the quarl is 2.4 times the diameter of the entrance of the quarl, and the inner periphery has an angle of 30 degrees with respect to the centerline. Four staging air inlets, equally spaced, are disposed at the circumference of the quarl. Flue gas is guided to mix with the primary combustion air and then enters the windbox 1 from the primary air intake 11. The quarl 6 is embedded, in a furnace while testing.

The burner has been tested at the Energy & Resources Laboratories of the Industrial Technology Research Institute (ERL) in the R.O.C. and at Research Cottrell Environment Service Technology inc. (RC-EST) in the U.S.A., respectively. Test data are plotted and listed in FIGS. 5 to 8 and table II.

Figure 5:
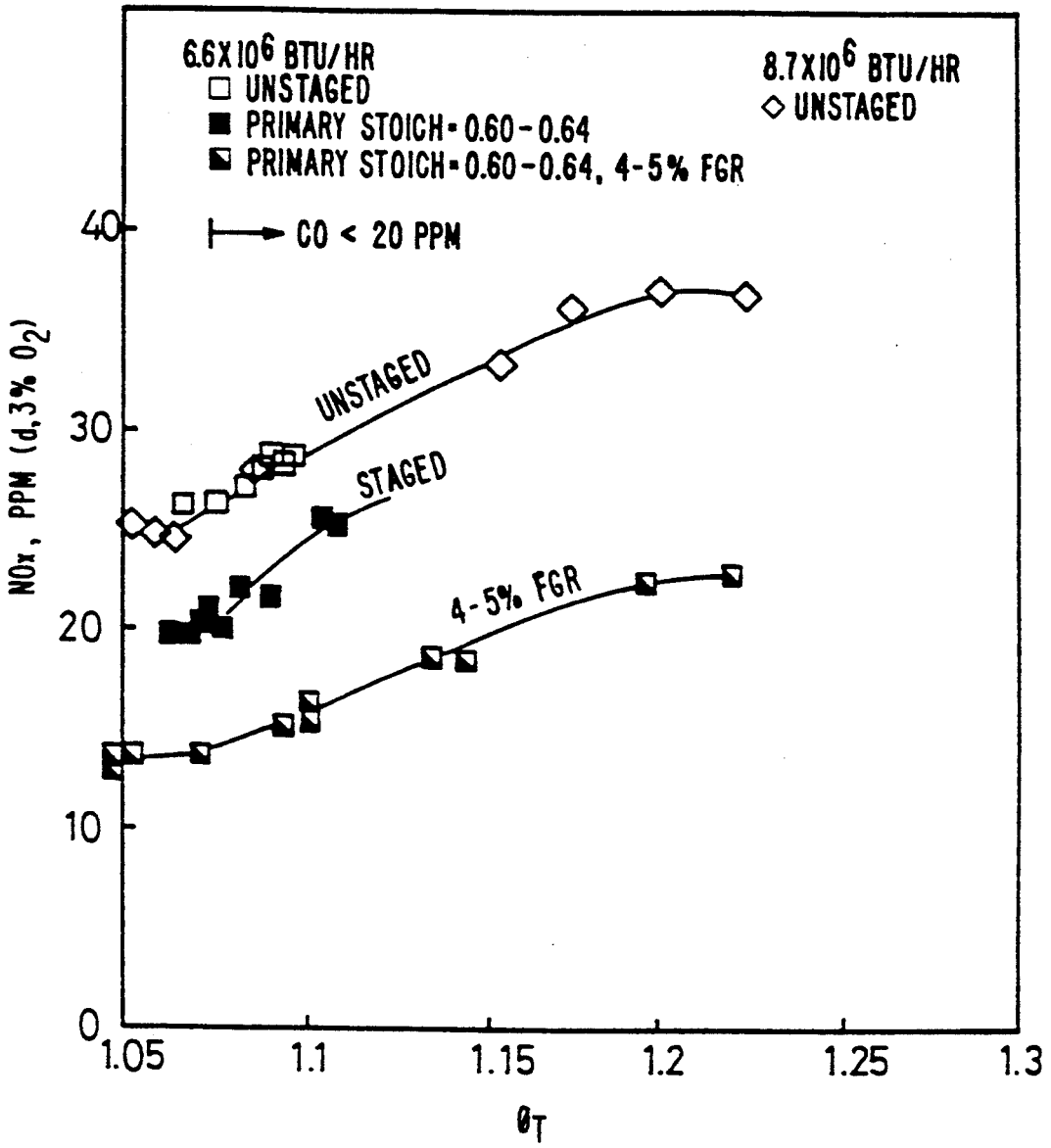
FIG. 5 shows the test data of the burner using gas fuel at the Energy & Resources Laboratories of the Industrial Technology Research Institute of the Republic of China (rated at $6.6–8.7\times10^6$ Btu/hr)
Figure 6:
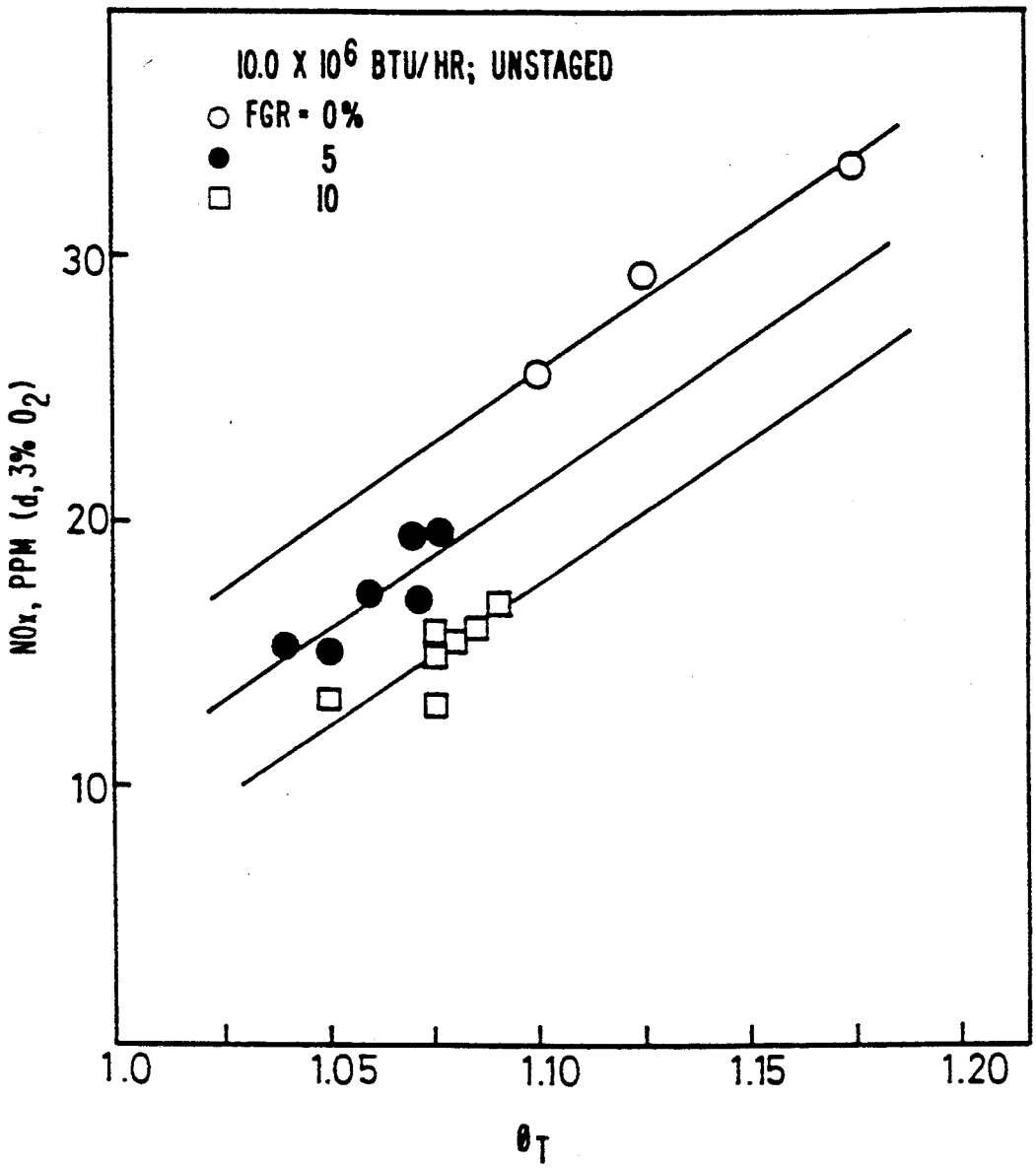
FIG. 6 shows the test data of the burner using gas fuel at the Energy & Resources Laboratories of the Industrial Technology Research Institute of the Republic of China (rated at $10\times10^6$ Btu/hr)

The data in FIGS. 5 and 6 are tested in the Energy & Resources Laboratories of the Industrial Technology Research Institute. In these diagrams, $\phi_T$ represents the total combustion air supplied over the minimum amount of air for complete combustion, FGR represents the recirculated flue gas over the total flue gas, UN-STAGED means no staging air, STAGED means staging air supplied, and PRIMARY STOICH represents the ratio primary air over the minimum amount of air for complete combustion. FIG. 5 shows that when the burner is operated at $6.6\times10^6$ Btu/hr, staging air achieves better $NO_x$ reduction than no staging air. If staging air and 4 to 5% flue gas recirculation are both applied, $NO_x$ emissions can be reduced to 13 ppm. FIG. 6 shows different results when operating at $10\times10^6$ Btu/hr without staging air. From FIG. 6 we can see that the reduction of $NO_x$ can be achieved by increasing the flue gas recirculation. The best result of 13 ppm is obtained when FGR is 10%.

Figure 7:
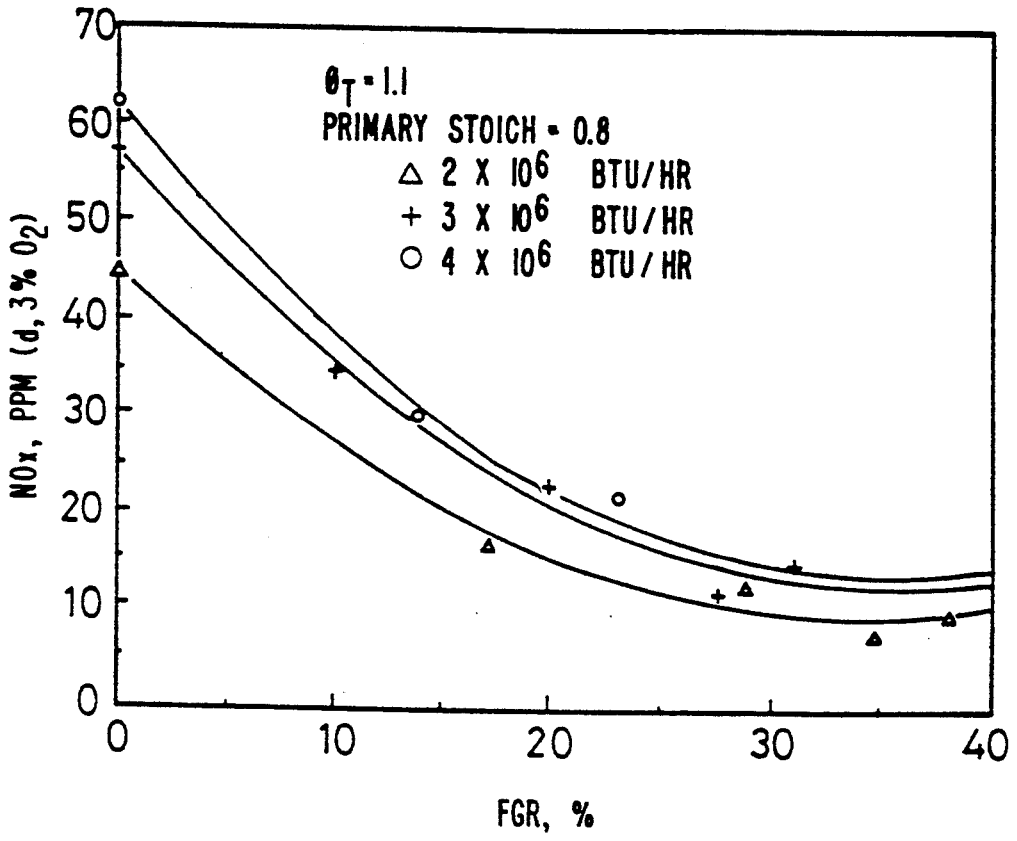
FIG. 7 shows the test data of the burner using gas fuel at R-C Environmental Service & Technologies in the U.S.A. (rated at $2–4\times10^6$ Btu/hr)
Figure 8:
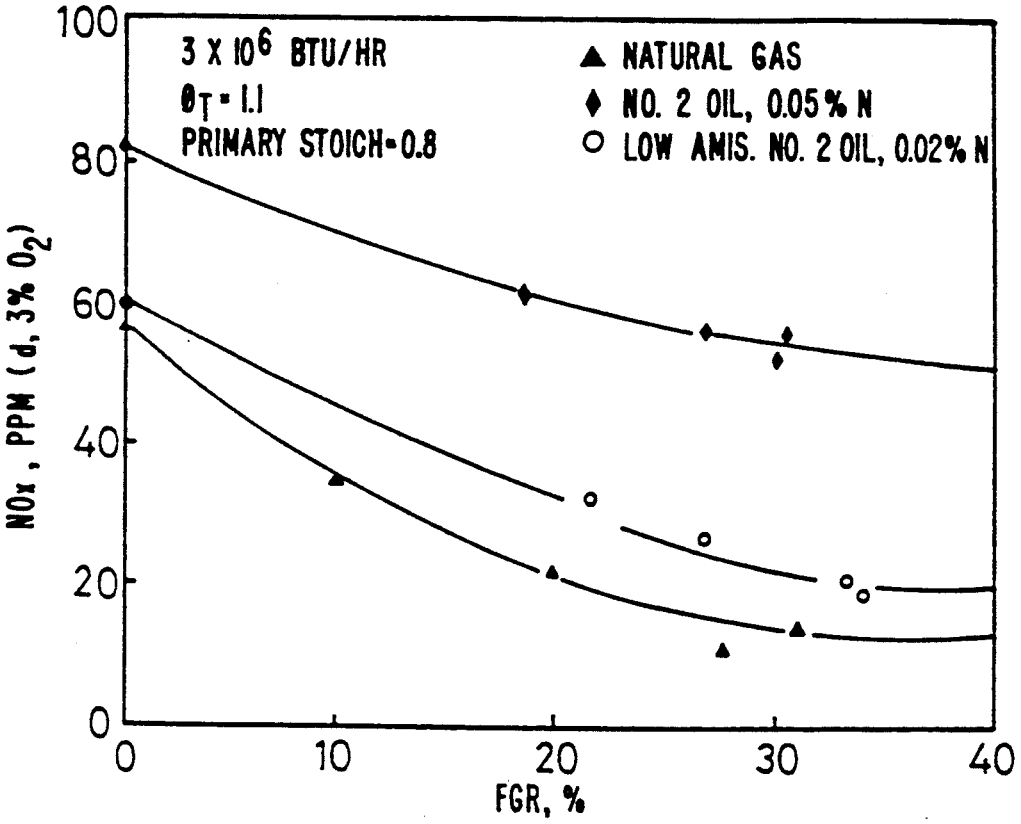
FIG. 8 shows the test data of the burner using oil fuel obtained at the R-C Environmental Service & Technologies in the U.S.A. (rated at $3\times10^6$ Btu/hr).

The data in FIGS. 7 and 8 were obtained at a different furnace at RC-EST, wherein the burner was operated at 2 to $4\times10^6$ Btu/hr. $NO_x$ emissions decreased when FGR increased. When operated at $4\times10^6$ Btu/hr, the best result of 8 ppm was achieved. In FIGS. 5 to 7, it is shown that when fueled with gas and operated at a wide range of 2 to $10\times10^6$ Btu/hr, the burner has stable performance and satisfactory low $NO_x$ emissions which are lower than those of conventional gas burners (ranging from 80 to 130 ppm).

FIG. 8 shows the results of liquid fuels including No. 2 oil (0.05% N) and Low Amis. No. 2 oil (0.02% N). The best result for Low Amis. No. 2 oil (0.02% N) is 20 ppm. The results of No. 2 oil (0.05% N) are not so good due to its higher fuel-$NO_x$, so the best result is 59 ppm.

Table II shows the results of No. 6 oil (0.3% N), tested at ERL. The best result is 103 ppm $NO_x$. All results range between 100 to 150 ppm, better than those of conventional oil burners which range between 250 to 330 ppm. It is conceivable that better values with $NO_x$ below 100 ppm can be achieved by applying flue gas recirculation at the same time.

TABLE II

| test data of No. 6 oil (0.3% N) ($8.4 \times 10^6$ Btu/hr, no flue gas recirculation) | | | | | |
|---|---|---|---|---|---|
| | | Flue Gas Analysis (Dry) | | | |
| Total Stoichiometry | Primary Zone Stoichiometry | Flue CO (ppm) | Flue $CO_2$ (% vol.) | Flue $O_2$ (% vol.) | Flue $NO_x$ (ppm) corrected to 3% $O_2$ |
| 1.15 | 1.00 | 20 | 13.3 | 3.0 | 153 |
| 1.05 | 0.90 | 24 | 15.2 | 1.0 | 136 |
| 1.10 | 0.90 | 22 | 14.3 | 2.0 | 146 |
| 1.05 | 0.80 | 100 | 15.0 | 1.0 | 105 |
| 1.07 | 0.80 | 68 | 14.8 | 1.3 | 112 |
| 1.05 | 0.70 | 200 | 15.1 | 0.9 | 103 |

While the invention has been described by way of example and in terms of several preferred embodiments, it is to be understood that the invention need not be limited to the disclosed embodiment on the contrary, it is intended to cover various modifications and similar arrangements included within the spirit and scope of the appended claims, the scope of which should be accorded the broadest interpretation so as to encompass all such modifications and similar structures.

What is claimed is:

1. A dual fuel burner comprising:

a divergent quarl having an entrance, and exit downstream from said entrance, and a plurality of axially extending staging air ports equally spaced around said exit;

a wind pipe coaxially connected to said entrance of said quarl;

a swirl generator coaxially received in said wind pipe, said swirl generator having a plurality of vanes and a center hole;

a gas gun including a tube and a gas nozzle, said tube having an upstream end and a downstream end and being coaxially positioned within said center hole of said swirl generator said gas nozzle being mounted to said downstream end of said tube and positioned in the vicinity of said entrance of said quarl, said gas nozzle having a plurality of passageways having centerlines that diverge in the downstream direction and are inclined at an angle of about 15 to 40 degrees with respect to the centerline of said quarl;

an oil gun including an oil tube, an oil nozzle, and a high pressure air tube, said oil gun tube having an upstream end and a downstream end, said oil gun tube being coaxially positioned within said gas gun tube, said oil nozzle being mounted to said downstream end of said oil gun tube and positioned in the vicinity of said entrance of said quarl, said oil nozzle including a plurality of passageways having centerlines that diverge in the downstream direction and are inclined at an angle of about 15 to 40 degrees with respect to the centerline of said quarl; said high pressure tube provided within said oil gun tube, said high pressure tube being in fluid communication with said oil nozzle passageways.

2. A burner as claimed in claim 1, wherein the outer diameter of said gas gun is 0.45 to 0.75 times the inner diameter of said wind pipe.

3. A burner as claimed in claim 1, wherein the diameter of said exit of said divergent quarl is 2 to 3 times the diameter of said entrance of said divergent quarl.

4. A burner as claimed in claim 1, wherein the inner periphery of said divergent quarl has an angle of 18 to 37 degrees with respect to the centerline of the burner.

5. A burner as claimed in claimed 1, wherein said oil nozzle passageways are "Y" shaped.

6. A dual fuel burner for injecting gas fuel and oil fuel and primary combustion air and staging air into a furnace wherein flue gas in produced after combustion, said dual fuel burner comprising:

a divergent quarl having an entrance, and exit downstream from said entrance, and a plurality of axially extending staging air ports equally spaced around said exit;

a wind pipe coaxially connected to said entrance of said quarl;

a swirl generator coaxially received in said wind pipe, said swirl generator having a plurality of vanes and a center hole;

a gas gun including a tube having an upstream end and a downstream end and being coaxially positioned within said center hole of said swirl generator, said gas gun further including a gas nozzle mounted to said downstream end of said gas gun tube and positioned in the vicinity of said entrance of said quarl, said gas nozzle having a plurality of passageways having centerlines that diverge in the downstream direction and are inclined at an angle of about 15 to 45 degrees with respect to the centerline of said quarl;

an oil gun including an oil gun tube having an upstream end and a downstream end, said oil gun tube being coaxially positioned within said gas gun tube, said oil gun further including an oil nozzle mounted to said downstream end of said oil gun tube and positioned in the vicinity of said entrance of said quarl, said oil nozzle including a plurality of passageways having centerlines that diverge in the downstream direction and are inclined at an angle of 15 to 40 degrees with respect to the centerline of said quarl, said oil gun further including a high pressure tube provided within said oil gun tube, said high pressure tube being in fluid communication with said oil nozzle.

7. A dual fuel burner as claimed in claim 6, wherein the flue gas is recirculated and mixed with the combustion air.

8. A dual fuel burner as claimed in claim 6, wherein the flue gas is recirculated and mixed with the staging air.

9. A dual fuel burner as claimed in claim 6, wherein the gas fuel is injected at a speed of 20 to 150 m/sec.

10. A dual fuel burner as claimed in claim 6, wherein the amount of the primary combustion air is 60% to 90% of the minimum amount of air required for complete combustion.

11. A dual fuel burner as claimed in claim 6, wherein the swirl number of the primary combustion air is 0.5 to 1.5.

12. A dual fuel burner as claimed in claim 6, wherein the total amount of the primary combustion air and the staging air is 1.05 to 1.3 times the minimum amount of air required for complete combustion.

13. A dual fuel burner as claimed in claim 6, wherein the divergent quarl has 3 to 8 said staging air inlets.

14. A dual fuel burner as claimed in claim 6, wherein the staging air enters at a speed of 14 to 80 m/sec.

15. A dual fuel burner as claimed in claim 6, wherein the oil fuel is injected at a speed of 80 to 400 m/sec.

16. A dual fuel burner as claimed in claim 6, wherein the average diameter of the injected oil fuel is 20 to 40 microns.

17. A dual fuel burner as claimed in claim 6, wherein the primary combustion air enters at a speed of 7 to 70 m/sec.

18. A dual fuel burner comprising:

a divergent quarl having an inlet, an outlet downstream from said inlet, and a plurality of axially extending staging air ports equally spaced about said outlet;

a wind pipe coaxially coupled to said quarl inlet;

a swirl generator coaxially arranged within said wind pipe, said swirl generator including a tubular member and a plurality of vanes extending therefrom, said tubular member forming a center hole;

a gas gun including;

a gas gun tube having an upstream end and a downstream end, said has gun tube being coaxially positioned within said center hole of the swirl generator; and a gas nozzle mounted to said downstream end of said gas gun tube, said has nozzle including a plurality of passageways that diverge in the downstream direction;

an oil gun including;

an oil gun tube having an upstream end and a downstream end, said oil gun tube being coaxially positioned within said gas gun tube;

an oil nozzle mounted to said downstream end of said oil gun tube and positioned in the vicinity of said entrance of said quarl, said soil nozzle including a plurality of passageways, the centerlines of said oil nozzle passageways that diverge in the downstream direction; and a high pressure tube provided within said oil gun tube, said high pressure tube being in fluid communication with said oil nozzle.

* * * * *